US006094844A

United States Patent [19]

Potts

[11] Patent Number: 6,094,844

[45] Date of Patent: Aug. 1, 2000

[54] SHOE POCKET AND METHOD OF USE

[76] Inventor: Matthew K. Potts, 2812 Cutler Ave., Fremont, Calif. 94536

[21] Appl. No.: 09/354,381

[22] Filed: Jul. 14, 1999

Related U.S. Application Data

[63] Continuation-in-part of application No. 09/170,296, Oct. 13, 1998.

[51] Int. Cl.[7] ..... A43B 23/00

[52] U.S. Cl. ..... 36/136; 36/54

[58] Field of Search ..... 36/136, 132, 1, 36/2.6, 54

[56] References Cited

U.S. PATENT DOCUMENTS

| | | | |
|---|---|---|---|
| 2,478,411 | 8/1949 | Martin | 36/136 |
| 2,507,991 | 5/1950 | Neal | 36/136 |
| 2,897,609 | 8/1959 | Bodkin | 36/136 |
| 3,328,900 | 7/1967 | Weitzner | 36/136 |
| 5,024,008 | 6/1991 | Maples | 36/136 |
| 5,644,858 | 7/1997 | Bemis . | |
| 5,664,341 | 9/1997 | Schnidt et al. . | |
| 5,692,324 | 12/1997 | Goldston et al. | 36/137 |
| 5,921,003 | 7/1999 | Kim | 36/3 |
| 5,921,008 | 7/1999 | Ruff . | |

*Primary Examiner*—Paul T. Sewell
*Assistant Examiner*—J. Mohandesi

[57] ABSTRACT

A shoe pocket, formed within the sole of footware such as a shoe, for storing objects such as keys, credit cards, matches, cigarettes, money clips, change, or specialized inserts. The shoe pocket comprises one or more recesses formed anywhere on the sole of the shoe, but preferably under the arch of the shoe, and with an opening to one side of the sole of the shoe. In one embodiment the object to be stored is placed directly in the recess in the sole of the shoe. In another embodiment, a housing is permanently affixed within the recess to receive the objects desired to be stored. In further embodiment, the housing is configured to receive an insert. The insert may itself be an object desired to be stored, such as a pedometer, a small computer, a calculator or other similar device, or the insert may be used to hold smaller objects such as keys, credit cards, etc., before being placed in the housing. In another embodiment, the housing is formed of a rigid material and provides arch support for the shoe. The invention also includes a method of storing objects within a pocket in the sole of the shoe.

15 Claims, 4 Drawing Sheets

SHOE POCKET AND METHOD OF USE

CROSS REFERENCE TO RELATED APPLICATION

The present invention is a continuation-in-part application of application Ser. No. 09/170,296, which claims as a priority date its filing date of Oct. 13, 1998.

FIELD OF THE INVENTION

This invention relates generally to footwear with one or more integral storage pockets, and more particularly to footwear including a sole with a storage pocket or recess formed within the sole.

BACKGROUND OF THE INVENTION

One problem frequently encountered by fitness and recreational sports enthusiasts is the problem of where to keep certain personal affects or necessary items such as keys, money or credit cards, or other such items, while participating in a chosen physical activity. An obvious solution is to carry such items in a pocket on the individual's apparel. However, not all sportswear includes pockets, and even if pockets are available, the presence of the items may distract the wearer, be uncomfortable, or cause slight but unacceptable deviations in a participants performance. Furthermore, objects may fall from the pockets and become lost.

Many prior art solutions have been advanced for carrying such articles on the participant's shoes. For example, previous solutions have included the use of pouches that may be attached to various parts of the upper portion of the shoe, above the sole of the shoe. The problem with these solutions is that many of the prior art designs flap loosely on the shoe, are difficult or inconvenient to attach or remove from the shoe, and may negatively impact the appearance of the shoe while worn. Furthermore, the pouch or contents thereof may be susceptible to being damaged or lost during some kinds of sports activities.

In order to address some of these problems, a number of prior art shoes have been devised that incorporate a pouch formed integrally on the upper portion of the shoe. While these designs overcome some of the disadvantages of other prior art pouches, such pouches and their contents may still be susceptible to damage and may not adequately provide for the security of the stored items. For instance, if the shoe is worn during a workout at a gym, the pouch or the contents of the pouch may become damaged by accidental contact between the shoe of the wearer and gym equipment. If the pouch is damaged or not secured, the contents of the pouch may fall out and become lost.

What is needed is a shoe pocket that is an integral part of the shoe, that will securely hold the objects intended to be stored, that can be used quickly and easily to stow or retrieve the stored items without the need to manipulate other portions of the shoe, and that will adequately protect the contents from damage or loss during use.

SUMMARY OF THE INVENTION

Accordingly, the present invention comprises a shoe pouch or pocket formed within the sole of a shoe. The shoe pocket of the invention includes a recess open to a side of the sole of the shoe that is capable of receiving objects to be stored. In some embodiments, the objects desired to be stored are placed directly in the recess, or in a housing formed within the recess. Objects may include, but are not limited to keys, credit cards, matches, cigarettes, money clips, and coins.

The object to be stored may also be a specialized insert. For example, inserts may be or include electronic devices or utility devices such as a calculator, a small computer, a pedometer for measuring the distance walked, a utility knife, a radio, or virtually any other object that can be manufactured with dimensions suitable for insertion in the housing. Alternatively, the insert may be configured to hold other smaller objects, such as keys, credit cards, matches, cigarettes, money clips, change, etc. In one embodiment a housing formed of a stiff material is placed within the recess in the sole of the shoe. In another embodiment the housing provides additional arch support for the shoe. In further embodiment the housing comprises a flexible elastomeric material. In another embodiment the invention includes a means for securely holding the insert within the housing. In a further embodiment, the securing means includes a mechanical locking means, and in another embodiment the insert is held in place by frictional contact with the interior surface of the housing. More than one recess may be provided in the shoe, and the recess and housing, if any, may be positioned at any point along the outer edge of the sole of the shoe. However, the recess is preferably positioned under the arch of the shoe.

The invention also includes a method of storing objects within a chamber formed in the sole of the shoe. The chamber may be defined by the sole of the shoe, or by the walls of a housing within the sole of the shoe. The method steps include: (A) providing a shoe having a shoe pocket formed in the sole of a shoe for storing an object, the shoe pocket including at least one chamber formed within the sole of a shoe, with the chamber being open at a side of the sole of the shoe, and wherein the chamber is sized to accept an object to be stored therein, (B) providing an object to be stored within the chamber, and (C) placing an object to be stored within the chamber. An alternate embodiment of the method may include the method step of: (A) providing a shoe having a shoe pocket formed in the sole of a shoe for storing an object, the shoe pocket including at least one chamber formed within the sole of a shoe, with the chamber being open at a side of the sole of the shoe, and wherein the chamber is sized to accept an insert, (B) providing an insert for holding an object to be stored, (C) providing an object to be stored within the insert, (D) placing the object to be stored within the insert, and (E) placing the insert within the chamber.

DETAILED DESCRIPTION OF THE INVENTION

The present invention comprises a shoe pouch formed within the sole of a shoe. The shoe pouch of the invention includes a recess openable to a side of the sole of the shoe that is capable of receiving objects to be stored. in some embodiments, the objects desired to be stored are placed directly in the recess, or in a housing formed within the recess. Objects may include, but are not limited to keys, credit cards, matches, cigarettes, money clips, change holders, and specialized modules, cartridges or inserts, hereafter "inserts," that may themselves be an object desired to be stored, or that may hold smaller items to be stored. More than one recess may be provided in the shoe, and the recess and housing, if any, may be positioned at any point along the outer edge of the sole of the shoe, although the recess is preferably positioned under the arch of the shoe.

Figure 1:
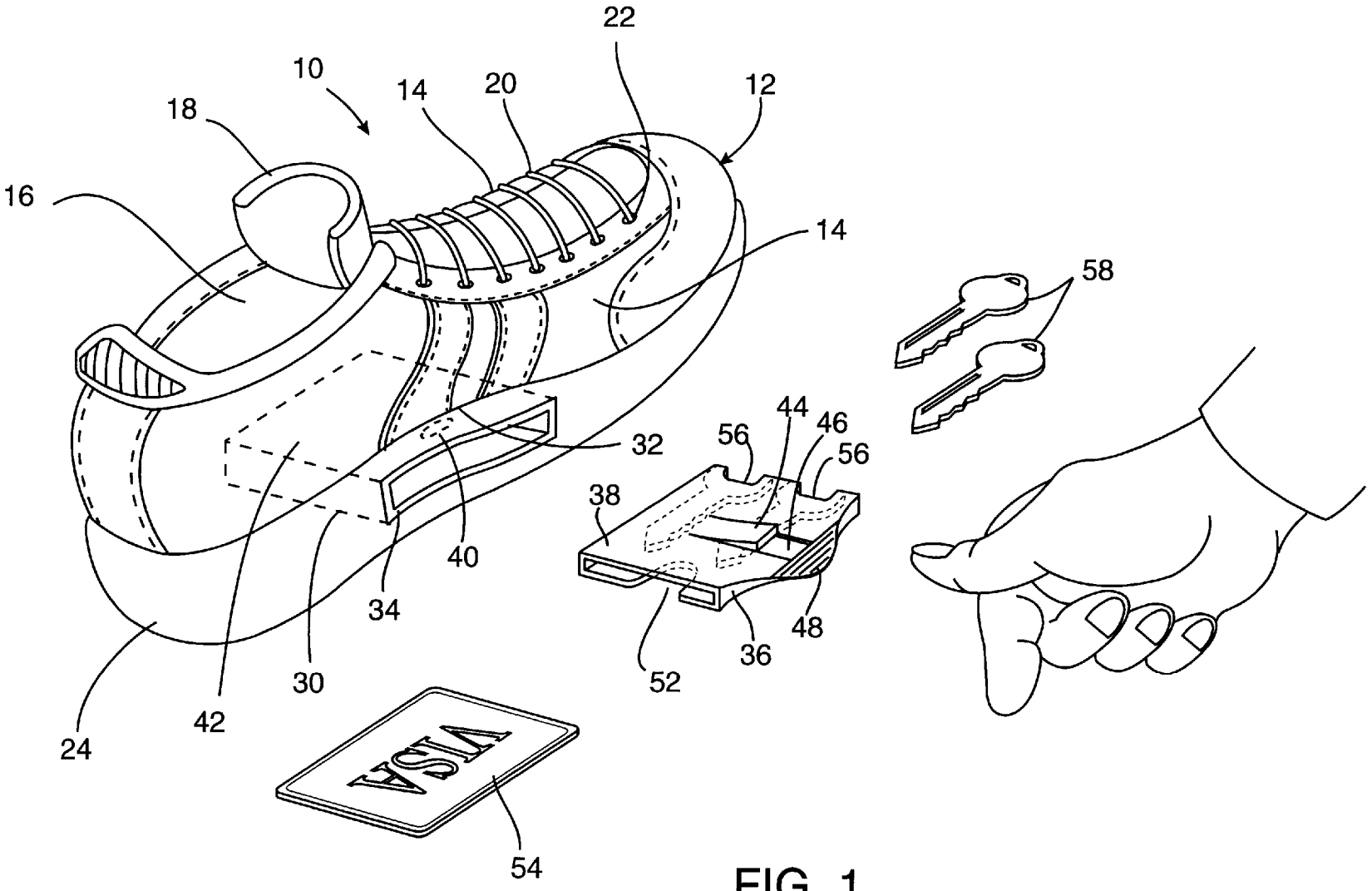
FIG. 1 shows a perspective view of an embodiment of the invention comprising a shoe pocket positioned under the arch of the shoe and an insert, for holding smaller objects, that fits into the shoe pocket.

The invention will now be described by reference to the Figures, wherein like numbers refer to similar features. An integral shoe pocket formed in accordance with the principles of the present invention is shown in FIG. 1. The athletic shoe 10 shown in FIG. 1 is a conventional generic athletic shoe 10. The shoe 10 includes a relatively soft and flexible upper portion 12 for surrounding at least part of the wearers foot, including a pair of side flaps 14 which define a foot recess 16, a shoe tongue 18 extending between the shoe side flaps 14, and a means for securing the shoe side flaps 14 to each other. The shoes shown in FIGS. 1 through 7 use laces 20 threaded through a plurality of lace eyelets 22 disposed along parallel, opposing sides of the side flaps 14, however, other fastening means such as VELCRO straps could be used. The shoe 10 further includes a sole 24 to provide protection from and cushion against uncomfortable contact with a supporting surface such as the ground. Typical materials used in the upper portion 12 of the shoe 10 include leather and man made sheet materials, such as polyvinyl or polyurethane sheets, or a combination thereof. The particular materials used in the upper portion 12 of the shoe 10 are not critical to the invention. These materials are frequently die-cut or laser-cut and stitched over a foot shaped last to form the finished upper portion 12. The sole 24 is typically molded or formed from one or more man-made elastomeric materials such as foamed or solid polyurethane or ethelyene vinyle acetate, and are configured to include common structural features such as a top or "footbed" surface, a peripheral outer or side wall surface 26, and a bottom or ground contacting surface. For simplicity, no layers are shown in the figures describing this invention, however, the sole 24 will typically further comprise a series of layers of differing materials with differing characteristics, such as a tough outsole component, a cushioned midsole component, and a soft insole component. The sole 24 is typically affixed on its upper surface to the lower margin of the upper portion 12 of the shoe 10 by the use of an adhesive.

Although the Figures referred to in this detailed description show the invention in use on a typical athletic shoe, it is understood that the invention could be incorporated in any kind of footwear having a sufficiently thick sole within which to form a recess or pocket, including but not limited to, boots, casual shoes, and dress shoes. Furthermore, the particular configuration of a shoe and the method of making the shoe are not critical to the invention, so long as the sole has sufficient thickness for the formation of a pocket therein.

The invention comprises a storage system for storing objects within pockets formed in the sole 24 of the shoe 10. Referring now to FIG. 1, a first embodiment of the invention is shown with a recess 30 formed in the sole 24 of the shoe 10 under the arch of the shoe 10. In this embodiment a rigid housing 34 is permanently affixed within the recess 30. Any suitable material may be used in the fabrication of the housing 34, however the material selected will preferably be relatively light yet capable of withstanding the conditions experienced by that portion of the sole 24 of the shoe 10. In the embodiment shown in FIG. 1, the invention further comprises an insert 36 that is received within the housing 34. The insert 36, and housing 34, may be of any size but preferably is not much larger than a credit card.

It is preferable that the insert 36 be easily insertable and removable while the shoe 10 is worn. However, it is also desirable that the insert be securely held within the housing 34 to prevent the insert 36 from being inadvertently ejected from the housing 34. Therefore , the housing 34 is preferably provided with a locking feature to prevent such occurrence. Any known means for securing the insert 36 within the housing 34 may be used, and the particular securing means selected is not critical to the invention. In the embodiment shown in FIG. 1, a cam locking mechanism is used comprising an aperture 40 in the upper wall 42 of the rigid housing 34, which is complementary to an over enter locking cam 44 molded onto an upper surface 38 of the insert 36 and carried on a joining member comprising a resilient arm 46 that can be depressed downward by a tab 48 on the resilient arm 46. Thus, to insert the insert 36, the user simply inserts the proper edge of the insert 36 into the housing 34 and pushes the insert 36 into the housing 34 until the cam 44 snaps into the aperture 40, thereby locking the insert 36 into place. To remove the insert 36, the user depresses the tab 48 until the locking cam 44 clears the aperture 42, and then pulls the insert 36 from the housing 34. The tab 48 preferably extends a short distance from the side of the sole 24 of the shoe 10 in order to allow the user to easily grip the tab 48.

Figure 2:
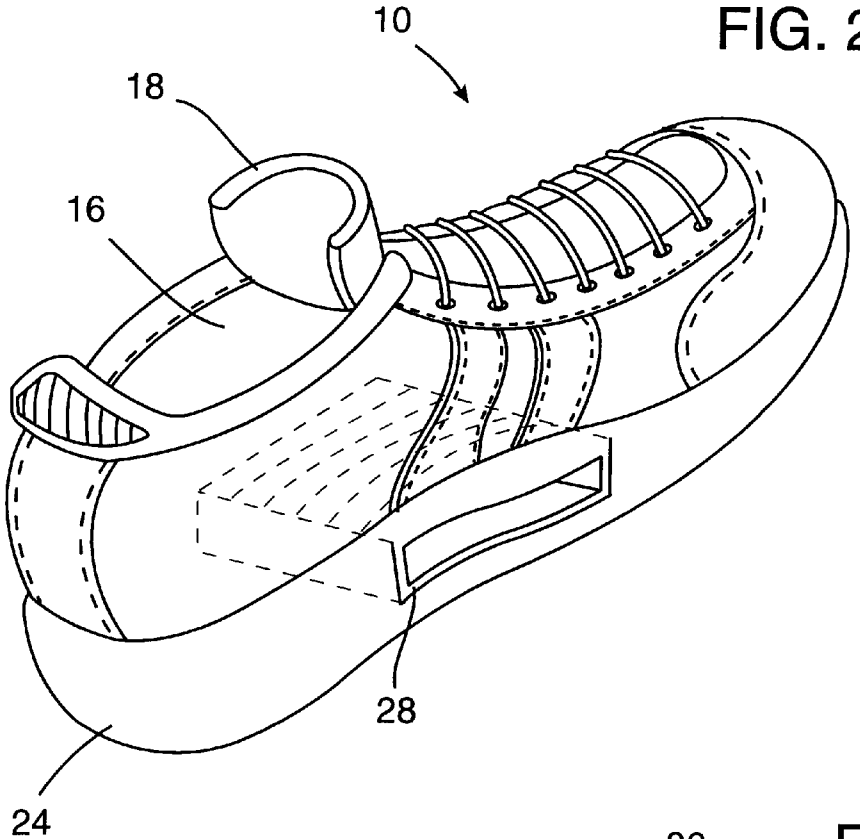
FIG. 2 shows an embodiment of the shoe pocket configured to assist in providing arch support for the shoe.

In an alternate embodiment of the rigid housing 34 seen in FIG. 2, the housing 34 is configured to provide arch support. In this embodiment the upper wall 50 of the housing 34 forms a convex arc to serve as an arch support base for the layers above.

Figure 3:
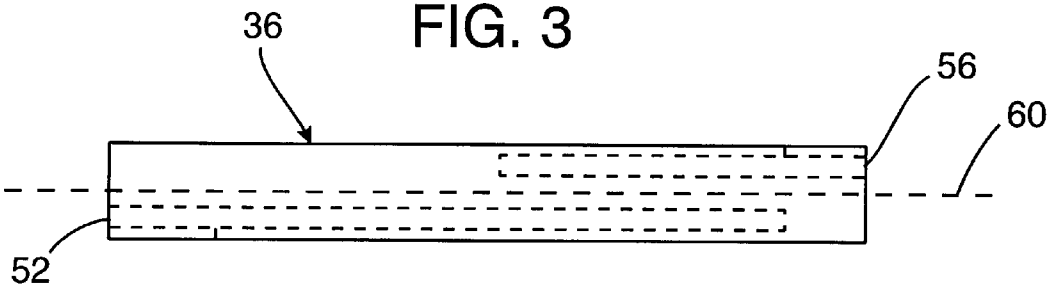
FIG. 3 shows a back view of the insert of FIG. 1.

The insert 36 of FIG. 1, comprises a flat rectangular box shape with a credit card opening 52 on one side configured to receive a credit card 54, and two key openings 56 on the opposite side configured to receive one key 58 each. FIG. 3 shows a back view of the insert 36 of FIG. 1. In order to reduce the width of the insert 36, it is preferable that the keys 58 and the credit card 54 are stacked within the insert 36. Specifically, the key openings 56 are formed above the centerline 60 of the insert 36, and the credit card opening 52 is formed below the centerline 60. Cut outs are formed in the walls of the insert 36 at the openings 52 and 56 in order to allow the user to grip the credit card 54 or keys 58 stored therein.

Figure 4:
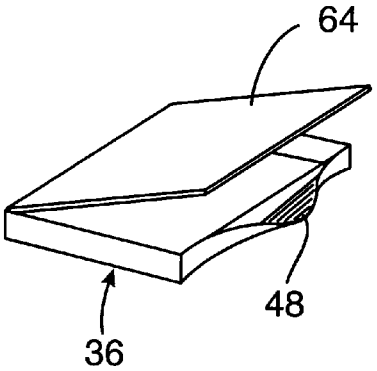
FIG. 4 shows an embodiment of the insert configured as a box with pivoting lid.

The configuration of the insert 36 is not limited to that discussed above. In alternate embodiments, the insert 36 may be formed in any useful configuration. For example, FIG. 4 shows an embodiment of the insert 36 configured as a simple box with a pivoting lid 64. Thus, in alternate embodiments, the insert could be fabricated in any desired configuration designed to store virtually any useful or desired objects, including but not limited to keys, credit cards, matches, cigarettes, money clips, and change. The insert 36 may also be useful device in itself, rather than a device configured to hold other smaller objects. For example, insert 36 could be or include electronic devices or utility devices such as a calculator, a small computer, a pedometer for measuring the distance walked, a utility knife, a radio, or virtually any other desired object that can be manufactured with dimensions suitable for insertion in the housing 34. There is no limit to the kinds of objects that may be carried.

In another alternate embodiment of the invention, the housing 34 in the recess 30 of the sole 24 may be formed of a flexible elastomeric material, rather than a rigid material. In this embodiment the housing 34 is sized to provide a friction fit to the insert 36 when inserted in the housing 34, thus no cam assembly or other mechanical fastening mechanism is required. The insert 36 may be inserted within the housing 34 by simply pushing the insert 36 into the housing 34. Frictional contact between the inner walls of the housing 34 and the outer surfaces of the insert 36 will tend to prevent the insert 36 from moving relative to the housing 34. To remove the insert 36, the user simply pulls on the tab 48 of the insert 36 with sufficient force to overcome the friction resistance.

Figure 5:
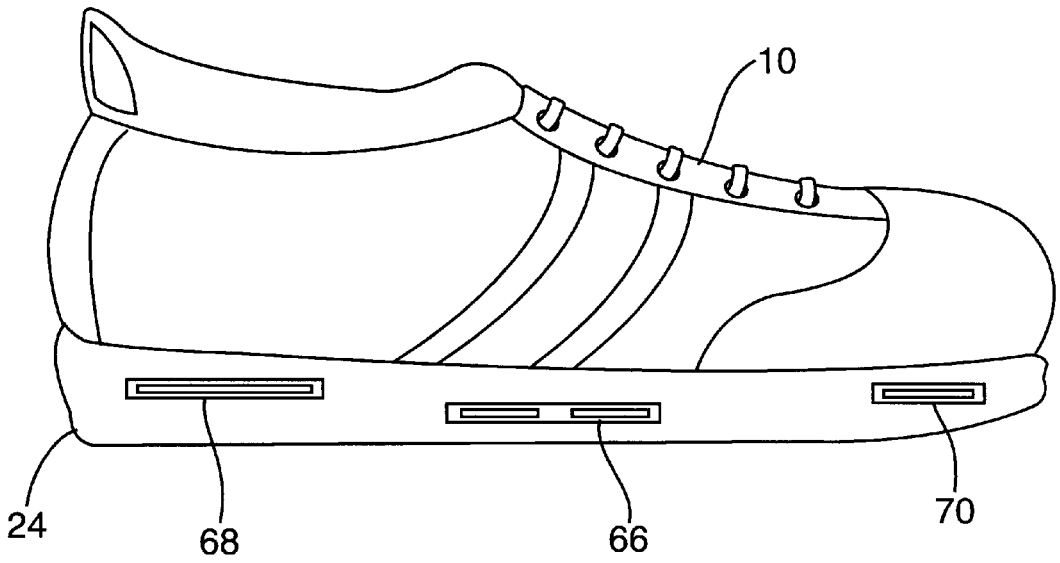
FIG. 5 shows an embodiment of the invention configured for storing objects directly in a housing in the recess formed in the sole of the shoe, without the use of an insert.

In another embodiment of the invention shown in FIG. 5, no insert 36 is used, and objects are stored directly in the housing 34. In another embodiment, the housing 34 may include slots to receive keys, credit cards and other objects. FIG. 5 shows a housing 66 positioned under the arch of the shoe 10 with slots for two keys, a housing 68 positioned under the heel of the shoe 10 and sized to received a credit card, and a housing 70 positioned in the toe of the shoe 10 and sized to receive a key. The housings 66–70 may use mechanical means to prevent the stored objects from inadvertently ejecting, or the housings 66–70 may be configured provide a friction fit for the objects to stored therein. Mechanical means to prevent the stored objects from inadvertently ejecting might include the use of a simple side door and latch that opens to the side of the sole 24 of the shoe 10. In another embodiment a known mechanical ejection apparatus, for example a ruggedized ejection assembly similar to those used in computers for floppy discs, may be used to partially eject the stored item.

If a friction fit is desired, it is preferable that a flexible elastomeric material be used in fabricating the housings 66–70. In this embodiment, the object to be stored may be inserted within one of the housings 66–70 by simply pushing the object into the opening. Frictional contact between the inner walls of the selected housing and the outer surfaces of the object stored therein will tend to prevent the object from moving relative to the selected housing. To remove the object, the user simply pulls on the objects with sufficient force to overcome the friction resistance. It is preferable that the object, when correctly positioned within the selected housing, extend a short distance from the side of the sole 24 of the shoe 10 so that the user may easily grip the object when it is desired to remove the object from the housing.

Figure 6:
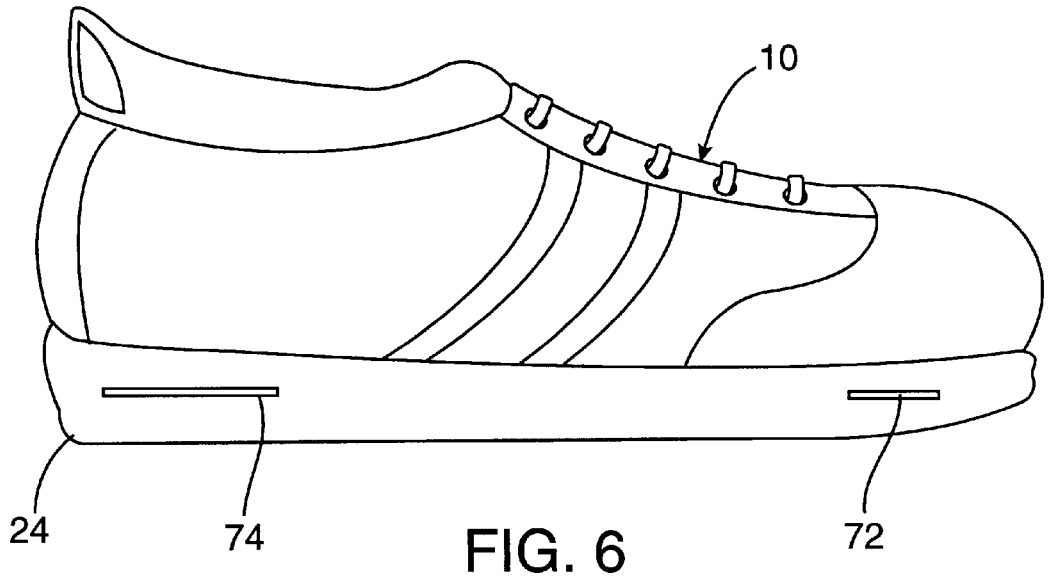
FIG. 6 shows another embodiment of the invention configured for storing objects directly in a recess formed in the sole of the shoe.

In yet another embodiment, the objects to be stored is placed directly in the recess 30 formed in the sole 24, without the use of a housing or an insert. Referring to FIG. 6, two slot shaped recesses, recess 72 under the heel and recess 74 under the toe of the shoe 10, are shown formed directly in the material of the sole 24. In this embodiment, the sole 24 is preferably formed of a material that will tend to grip an object placed within the recess 72 or 74. The object to be stored may be inserted within the recess 72 or 74 by simply pushing the object into the recess 72 or 74. Frictional contact between the inner walls of the recess 72 or 74 and the outer surfaces of the object, will tend to prevent the object from moving relative to the recess 72 or 74. To remove the object, the user simply pulls on the object with sufficient force to overcome the friction resistance. When the object is correctly positioned within the recess, it is preferable that the object extend a short distance from the side of the sole 24 of the shoe 10 so that the user may easily grip the object for removal from the recess.

Figure 7:
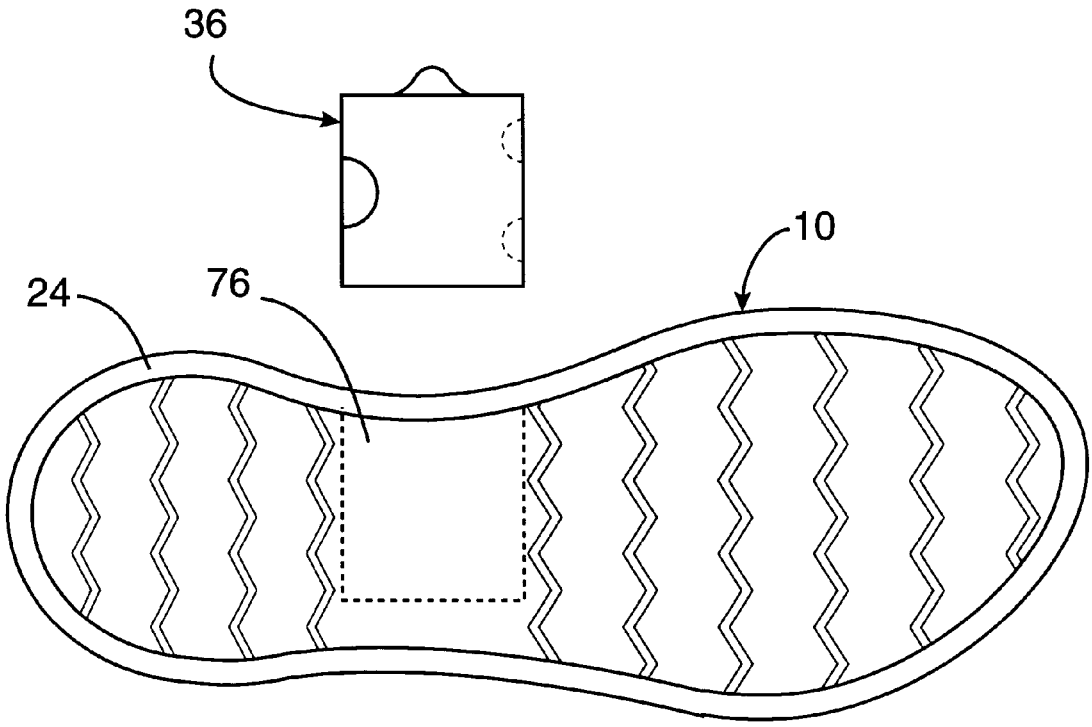
FIG. 7 shows a bottom view of an embodiment of the invention wherein the recess in the sole of the shoe does not include a housing, and wherein the insert is received directly in the recess.

In an additional alternate embodiment, an insert is used in combination with a recess formed directly in the sole of the shoe, but without the use of a housing. For example, FIG. 7 shows a bottom view of the shoe 10 with a recess 76 positioned under the arch of the shoe 10 and sized to receive the insert 36 that is configured to hold a credit card and two keys. The sole 24 is preferably formed of a material that will tend to grip the insert 36 placed within the recess 76. In this embodiment, the insert 36 may be inserted within the recess 76 by simply pushing the insert 36 into the recess 76. Frictional contact between the inner walls of the recess 76 and the outer surfaces of the insert 36 will tend to prevent the insert 36 from moving relative to the recess 76. To remove the insert 36, the user simply pulls on the insert 36 by the tab 48 with sufficient force to overcome the friction resistance.

In general, it is preferred that the recess and, if present, the housing and insert, be positioned under the arch of the shoe because the elements of the invention are least likely to be noticed in this location, and because components inserted in the shoe in this location are least likely to interfere with the performance and comfort of the shoe. However, one or more recesses and any housings or inserts placed therein could be positioned at virtually any other desired location on the sole of the shoe. The openings of the recesses could be oriented differently than shown in FIGS. 1 through 7. For example, in FIG. 5, the opening of the recess 68 in the heel could be oriented toward the back of the shoe 10, or the opening of the recess 70 in the toe of the shoe 10 could be oriented toward the front of the shoe 10.

The invention also includes a method of storing objects within a pocket or chamber formed in the sole of the shoe. The chamber may be defined by the sole of the shoe, or by the walls of a housing within the sole of the shoe. The method steps include: (A) providing a shoe having a shoe pocket formed in the sole of a shoe for storing an object, the shoe pocket comprising at least one chamber formed within the sole of a shoe, with the chamber being open at a side of the sole of the shoe, and wherein the chamber is sized to accept an object to be stored therein, (B) providing an object to be stored within the chamber, and (C) placing an object to be stored within the chamber. An alternate embodiment of the method may include the method step of: (A) providing a shoe having a shoe pocket formed in the sole of a shoe for storing an object, the shoe pocket comprising at least one chamber formed within the sole of a shoe, with the chamber being open at a side of the sole of the shoe, and wherein the chamber is sized to accept an insert to be stored therein, (C) providing an insert for holding an object to be stored, (B) providing an object to be stored, (D) placing the object to be stored within an insert, and (E) placing the insert within the chamber.

To those skilled in the art, many changes and modifications will be readily apparent from the consideration of the foregoing description of a preferred embodiment without departure from the spirit of the present invention. The description herein and the disclosures hereof are by way of illustration only and should not be construed as limiting the scope of the present invention which is more particularly pointed out by the following claims.

What is claimed is:

1. A shoe comprising:

an upper;

a sole connected to the upper;

a recess formed in the side of the sole;

an insert with a top surface, a closed bottom surface and sides, and wherein the insert has at least one opening at a side configured to receive an object; whereby the surfaces and perimeters of the object received make substantial contact with the internal elements of the insert; and including a means for securing the insert within the recess including a cam locking mechanism carried on a joining member comprising a cam, an aperture formed on a recess interior wall and the cam and joining member comprising a movable connection between the cam and a tab; whereby said cam locks, or "snaps" into the aperture upon placement of the insert into the recess; and whereby when said tab is depressed the movement of the joining member releases the cam from the aperture to permit removal of the insert.

2. The shoe of claim 1 wherein the insert is further secured within the recess by frictional contact between the surfaces of the recess and the surfaces of the insert.

3. The shoe of claim 1 wherein the recess is positioned at the arch portion of the sole.

4. The shoe of claim 1 wherein the cam locking mechanism comprises at least one aperture in the ceiling of the recess and at least one cam extending from the outer top surface of the insert.

5. The shoe of claim 4 wherein the object is at least one key.

6. The shoe of claim 4 wherein the object is at least one credit card.

7. The shoe of claim 5 wherein the object is inserted and removed from the back side of a rectangular insert.

8. The shoe of claim 5 wherein the object is inserted and removed from either of the shortest opposite sides of a rectangular insert.

9. The shoe of claim 6 wherein the object is inserted and removed from the back side of a rectangular insert.

10. The shoe of claim 6 wherein the object is inserted and removed from either of the shortest opposite sides of a rectangular insert.

11. The shoe of claim 10 wherein the object is placed in a slot.

12. The shoe of claim 1 wherein the insert is released from the recess when a tab with a movable arm connected to a cam is depressed downward, thereby disengaging the cam from the aperture.

13. The shoe of claim 12 whereby the tab is connected to the cam by the top surface of the insert.

14. The shoe of claim 1 wherein the object is an electronic device.

15. The shoe of claim 1 wherein a housing is inserted into the recess, and the insert is inserted into a housing.

* * * * *